US010493529B2

(12) United States Patent
Shimojima et al.

(10) Patent No.: US 10,493,529 B2
(45) Date of Patent: Dec. 3, 2019

(54) HIGH TEMPERATURE OXIDATION RESISTANT RARE METAL-FREE HARD SINTERED BODY AND METHOD OF MANUFACTURING THE SAME

(71) Applicant: NATIONAL INSTITUTE OF ADVANCED INDUSTRIAL SCIENCE AND TECHNOLOGY, Tokyo (JP)

(72) Inventors: Koji Shimojima, Aichi (JP); Ryouichi Furushima, Aichi (JP); Hiroyuki Hosokawa, Aichi (JP); Kiyotaka Katou, Aichi (JP); Akihiro Matsumoto, Aichi (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 20 days.

(21) Appl. No.: 15/517,207

(22) PCT Filed: Oct. 2, 2015

(86) PCT No.: PCT/JP2015/078102
§ 371 (c)(1),
(2) Date: Apr. 6, 2017

(87) PCT Pub. No.: WO2016/056487
PCT Pub. Date: Apr. 14, 2016

(65) Prior Publication Data

US 2017/0304898 A1 Oct. 26, 2017

(30) Foreign Application Priority Data

Oct. 10, 2014 (JP) ..... 2014-208551

(51) Int. Cl.
*B22F 3/00* (2006.01)
*B22F 3/14* (2006.01)
(Continued)

(52) U.S. Cl.
CPC ..... *B22F 3/14* (2013.01); *B22F 1/0059* (2013.01); *C22C 29/02* (2013.01); *C22C 29/04* (2013.01);
(Continued)

(58) Field of Classification Search
None
See application file for complete search history.

(56) References Cited

U.S. PATENT DOCUMENTS 5,637,816 A * 6/1997 Schneibel ..... C22C 29/00 419/12

FOREIGN PATENT DOCUMENTS

JP 2611177 2/1997
JP 2003113438 * 10/2001 ..... C22C 29/08
(Continued)

OTHER PUBLICATIONS

Furushima et al., "Relationship between hardness and fracture toughness in WC-FeAl composites fabricated by pulse current sintering technique", Jan. 2014, Int. Journal of Refractory Metals and Hard Materials, vol. 42, pp. 42-46.*
(Continued)

*Primary Examiner* — Seth Dumbris
(74) *Attorney, Agent, or Firm* — Wenderoth, Lind & Ponack, L.L.P.

(57) ABSTRACT

Provided is a hard sintered body which exhibits excellent high temperature oxidation resistance and has a high hardness at a high temperature. In the hard sintered body, a binder phase is contained at from 8.8 to 34.4 mol % and the balance is composed of a hard phase and inevitable impu-
(Continued)

rities. The binder phase contains iron aluminide containing FeAl as a main component and alumina that is dispersed in iron aluminide and has a particle size of 1 μm or less. The hard phase is composed of at least one kind selected from carbides, nitrides, carbonitrides and borides of Group 4 metals, Group 5 metals and Group 6 metals in the periodic table, and solid solutions of these. This hard sintered body is obtained by mixing and pulverizing a binding particle powder containing an iron aluminide powder composed of at least one kind selected from $FeAl_2$, $Fe_2Al_5$ and $FeAl_3$ and a hard particle powder composed of at least one kind selected from carbides, nitrides, carbonitrides and borides of Group 4 metals, Group 5 metals and Group 6 metals in the periodic table and then sintering a mixed powder thus obtained.

10 Claims, 6 Drawing Sheets

(51) Int. Cl.

| | |
|---|---|
| ***C22C 29/02*** | (2006.01) |
| ***B22F 1/00*** | (2006.01) |
| ***C22C 29/04*** | (2006.01) |
| ***C22C 29/14*** | (2006.01) |
| ***C22C 29/16*** | (2006.01) |
| *B22F 7/06* | (2006.01) |
| *C22C 29/08* | (2006.01) |
| *B22F 5/00* | (2006.01) |

(52) U.S. Cl.
CPC ..... *C22C 29/14* (2013.01); *C22C 29/16* (2013.01); *B22F 2005/001* (2013.01); *B22F 2201/02* (2013.01); *B22F 2201/11* (2013.01); *B22F 2201/20* (2013.01); *B22F 2302/10* (2013.01); *B22F 2302/15* (2013.01); *B22F 2998/10* (2013.01); *C22C 29/08* (2013.01); *Y10T 428/1209* (2015.01); *Y10T 428/12049* (2015.01); *Y10T 428/12056* (2015.01)

(56) References Cited

FOREIGN PATENT DOCUMENTS

| | | |
|---|---|---|
| JP | 2003-113438 | 4/2003 |
| WO | 96/20902 | 7/1996 |
| WO | 99/39016 | 8/1999 |

OTHER PUBLICATIONS

Furushima et al., "Effect of Oxygen Content in WC-FeAl Powders on Microstructure and Mechanical Properties of Sintered Composites Fabricated by Pulse Current Sintering Technique", Oct. 2014, Materials Transactions, vol. 55, pp. 1792-1799.*

International Search Report dated Dec. 28, 2015 in International Application No. PCT/JP2015/078102.

Koji Shimojima et al., "TiC based Hard Material with High Oxidation Resistance at High Temperature", Euro PM2015.

Koji Shimojima et al., "TiC/TiCN-based hard material with high oxidation resistance at high temperature", Metal Powder Report, Jun. 2016.

* cited by examiner

HIGH TEMPERATURE OXIDATION RESISTANT RARE METAL-FREE HARD SINTERED BODY AND METHOD OF MANUFACTURING THE SAME

TECHNICAL FIELD

The present invention relates to a hard sintered material suitable for a cutting tool such as a throwaway tip, a wear-resistant tool, a corrosion-resistant part, a high temperature member, and the like. Specifically, it relates to an inexpensive hard sintered body improved in high temperature oxidation resistance, hardness, and the like by uniformly dispersing fine aluminum oxide in the metallic binder phase not containing a rare metal, and a method of manufacturing the same.

BACKGROUND ART

Hitherto, cemented carbide (WC—Co alloy or the like) obtained by sintering tungsten carbide powder with cobalt, nickel, or the like has been widely used in materials required to exhibit wear resistance, strength, and heat resistance for cutting tools, molds, heat resistant and wear resistant parts. The oxidation of this cemented carbide rapidly proceeds when it is used in a high temperature state of 600° C. or higher in the atmospheric air, and this cemented carbide is necessarily used at a temperature lower than this. However, cutting and mold machining at a high temperature state are increasingly required with the progress of machining technology, and a hard material usable at a higher temperature is demanded.

On the other hand, tungsten is a rare metal having country risk since the tungsten mine which is the raw material for tungsten carbide is unevenly distributed in some areas. For this reason, a cermet obtained by sintering a titanium carbide powder or a titanium carbonitride powder with cobalt, nickel, or the like is used instead of tungsten carbide. Cermet exhibits higher hardness and superior oxidation resistance as compared to cemented carbide.

However, cobalt and nickel are also rare metals of which the depletion as a resource is concerned. In addition, cobalt is designated as Class 1 Designated Chemical Substance in PRTR Law and Class 2 Specified Chemical Substance in Occupational Safety and Health Law, and it is thus not desirable to use cobalt from the viewpoint of cost and environmental convergence. From the facts described above, it is desired to develop inexpensive materials for tools which have resources to be stably supplied and do not contain a rare metal. As one measure to cope with the rare metal, a cemented carbide having a binder phase composed of one kind or two kinds between Fe and Al instead of cobalt is known (for example, Patent Literature 1). A hard material which does not contain a rare metal is obtained when the binder phase of cermet having titanium carbide (TiC) or titanium carbonitride (TiCN) in a hard phase is changed from cobalt or nickel to an intermetallic compound such as iron aluminide.

In the manufacturing methods of a composite material having iron aluminide as a binder phase, there is a method in which Fe, Al, and hard particles are mixed and Fe and Al are reacted at the time of sintering to produce FeAl, but it is difficult to increase the transverse rupture strength since it is difficult to refine crystal grains (for example, Patent Literatures 1 and 2). In addition, in a manufacturing method of a composite material in which an FeAl powder (pre-alloy) obtained by previously synthesizing Fe and Al by combustion synthesis or the like and pulverizing the synthesized substance and hard particles are mixed and pulverized together with additives and then sintered, the hardness of the composite material is improved by increasing the mixing and pulverization time (for example, Patent Literature 3).

However, the grain refinement proceeds and, at the same time, oxidation of the mixed powder also proceeds when the mixing and pulverization time is increased. As a result, although material properties such as hardness are improved, there is a problem that FeAl and oxygen adsorbed on the mixed powder surface are converted into Fe and $Al_2O_3$ through the reaction represented by the following chemical reaction formula (1) and the oxidation resistance thus decreases as the oxidized FeAl mixed powder is exposed to a high temperature at the time of sintering.

$$4FeAl+3O_2 \rightarrow 4Fe+2Al_2O_3 \quad (1)$$

In addition, in the manufacturing method of a composite material in which a preform is formed from hard particles and FeAl is infiltrated into the preform, there is a problem that it is difficult to densify the composite material and the hardness and transverse rupture strength of the composite material decrease.

CITATION LIST

Patent Literature

Patent Literature 1: JP 2611177 B1
Patent Literature 2: JP 10-511071 W
Patent Literature 3: JP 2002-501983 W

DISCLOSURE OF THE INVENTION

Problem to be Solved by the Invention

The present invention has been made in view of the above-described problems, and an object thereof is to provide a hard sintered body which does not use a rare metal, is equipped with a transverse rupture strength usable as a tool, exhibits excellent high temperature oxidation resistance, has a high hardness at a high temperature, and is inexpensive, and a method of manufacturing the same.

Means for Solving Problem

The present invention includes the following technical means to solve the problems described above.

A hard sintered body of the present invention includes a binder phase at from 8.8 to 34.4 mol % and the balance being a hard phase and inevitable impurities, wherein the binder phase contains iron aluminide containing FeAl as a main component and alumina that is dispersed in the iron aluminide and has a particle size of 1 μm or less, and the hard phase includes at least one kind selected from carbides, nitrides, carbonitrides and borides of Group 4 metals, Group 5 metals and Group 6 metals in the periodic table, and solid solutions of these.

A method of manufacturing a hard sintered body of the present invention includes: a mixing and pulverizing step of mixing and pulverizing a binding particle powder containing an iron aluminide powder including at least one kind selected from $FeAl_2$, $Fe_2Al_5$ and $FeAl_3$ and a hard particle powder including at least one kind selected from carbides, nitrides, carbonitrides and borides of Group 4 metals, Group 5 metals and Group 6 metals in the periodic table to obtain a mixed powder; and a sintering step of sintering the mixed powder.

The cutting or wear-resistant tool of the present invention includes the hard sintered body of the present invention as a raw material.

EFFECT OF THE INVENTION

According to the present invention, a hard sintered body which exhibits excellent high temperature oxidation resistance and has a high hardness at a high temperature is obtained at low cost.

MODES FOR CARRYING OUT THE INVENTION

Figure 1:
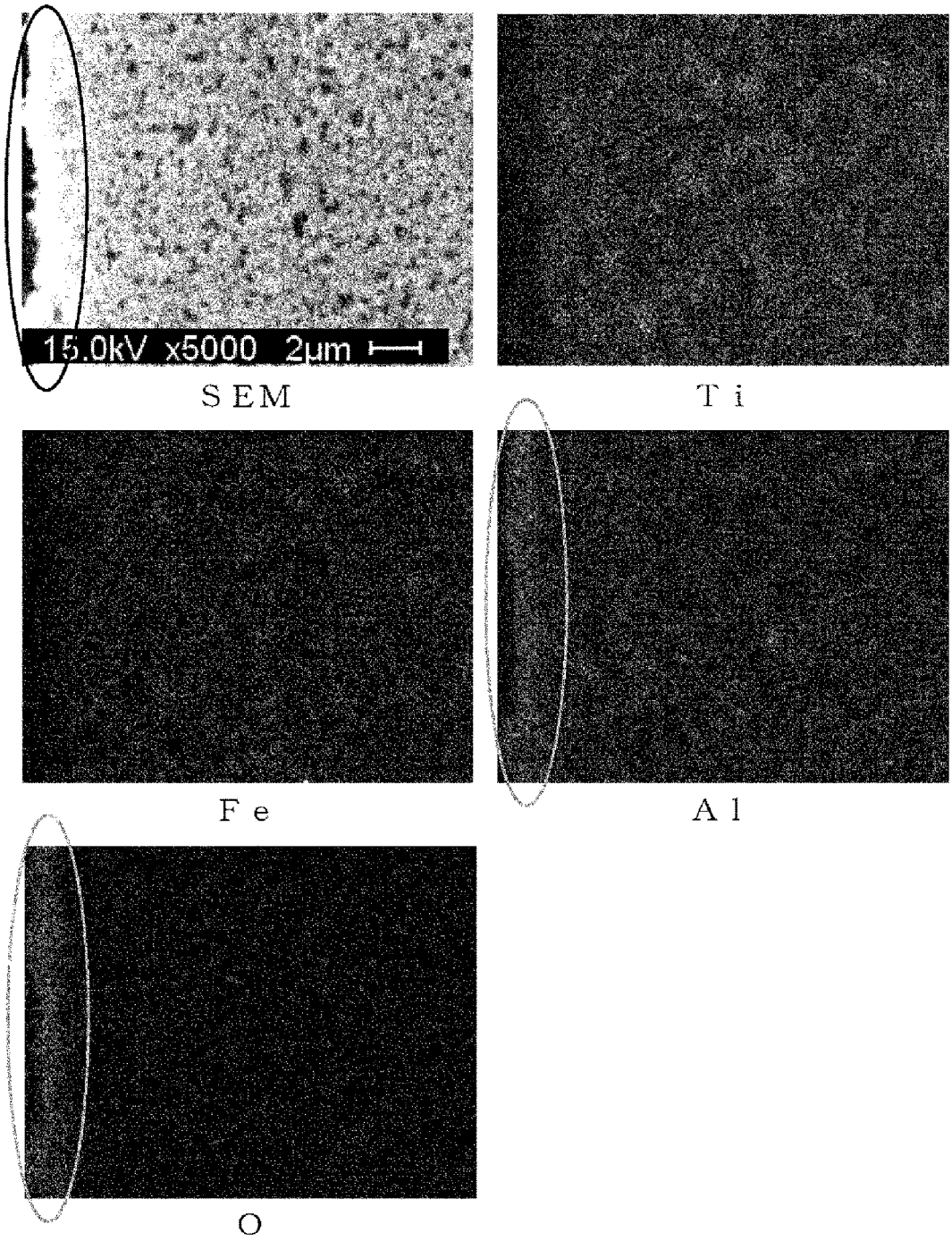
FIG. 1 illustrates the results for observation of a cross section of a hard sintered body of A3 of Example after a high temperature oxidation test and energy dispersive X-ray spectrometric analysis of each element.

Hereinafter, a hard sintered body, a method of manufacturing this hard sintered body, and a tool using this hard sintered body as a raw material of the present invention will be described in detail based on embodiments and Examples with reference to the tables and the drawings. Incidentally, the overlapping explanation will be omitted as appropriate. In addition, in a case in which the term "to" is described between two numerical values to represent a numerical range, these two numerical values are also included in the numerical range.

The hard sintered body according to an embodiment of the present invention contains a binder phase, a hard phase, and inevitable impurities. The content of the binder phase in the hard sintered body is preferably from 2.4 to 53 mol %. This content makes it possible to obtain a hard sintered body exhibiting balanced transverse rupture strength, high temperature oxidation resistance, hardness, and fracture toughness. When the content of the binder phase in the hard sintered body is less than 2.4 mol %, the transverse rupture strength and the high temperature oxidation resistance are inferior although the hardness increases. The hardness is inferior when the content of the binder phase in the hard sintered body is more than 53 mol %.

The binder phase contains iron aluminide and alumina. Iron aluminide contains FeAl as a main component. Alumina has a particle size of 1 μm or less and is dispersed in this iron aluminide. The hard phase is composed of at least one kind selected from carbides, nitrides, carbonitrides and borides of Group 4 metals, Group 5 metals and Group 6 metals in the periodic table, and solid solutions of these. Group 4 metals in the periodic table are Ti, Zr and Hf, Group 5 metals are V, Nb and Ta and Group 6 metals are Cr, Mo and W. Among these, the hard phase is preferably composed of at least one kind selected from carbide, nitride, carbonitride and boride of Ti, and solid solutions of these or at least either of tungsten carbide or a solid solution thereof.

Depending on the composition of the hard sintered body of the present embodiment, at least one kind (hereinafter referred to as the "additives" in some cases) selected from boron, silicon, chromium, niobium and molybdenum may be contained in the binder phase for the purpose of improving high temperature properties and hardness. By containing the additives in the binder phase, it is possible to expect densification due to improvement in sinterability, improvement in high temperature creep properties, and improvement in oxidation resistance properties. The content of the additives in the hard sintered body is preferably more than 0 mol % and 25 mol % or less. When the content of the additives in the hard sintered body is too high, it becomes an obstructive factor of sintering and various kinds of properties of the hard sintered body deteriorate.

The content of the binder phase in the hard sintered body is more preferably from 8.8 to 34.4 mol %. This content makes it possible to obtain a hard sintered body exhibiting excellent fracture toughness, transverse rupture strength, and high temperature oxidation resistance while having a high hardness. When the content of the binder phase in the hard sintered body is low, the transverse rupture strength and the high temperature oxidation resistance are inferior although the hardness increases. When the content of the binder phase in the hard sintered body is too high, the hardness is inferior. Moreover, the content of alumina in the binder phase is preferably from 24.2 to 50.0 mol %. This is because the heat resistance of the hard sintered body decreases when the content of alumina in the binder phase is low and it is difficult to obtain a dense hard sintered body when the content of alumina in the binder phase is too high. In addition, the aluminum content in iron aluminide in the binder phase is preferably from 24.6 to 57.7. The fracture toughness value decreases when the aluminum content is higher than this range, and the high temperature oxidation resistance decreases when it is lower than this range.

The method of manufacturing a hard sintered body of the present invention includes a mixing and pulverizing step and a sintering step. In the mixing and pulverizing step, a binding particle powder and a hard particle powder are mixed and pulverized to obtain a mixed powder. Here, the binding particle powder contains an iron aluminide powder composed of iron and aluminum that is excessively present with respect to iron, for example, an iron aluminide powder composed of at least one kind selected from $FeAl_2$, $Fe_2Al_5$ and $FeAl_3$. This iron aluminide powder is a material for binder phase. The hard particle powder is composed of at least one kind selected from carbides, nitrides, carbonitrides and borides of Group 4 metals, Group 5 metals and Group 6 metals in the periodic table. Among these, the hard particle powder is preferably composed of at least one kind selected from carbide, nitride, carbonitride and boride of Ti, or tungsten carbide powder.

In the sintering step, the mixed powder obtained in the mixing and pulverizing step is sintered. Through the mixing and pulverizing step and the sintering step, a hard sintered body having a binder phase containing iron aluminide containing $Fe_3Al$ or FeAl as a main component and alumina that is dispersed in this iron aluminide and has a particle size of 1 μm or less is obtained. As sound $Fe_3Al$ or FeAl is contained in the binder phase as the main component, the hard sintered body becomes an inexpensive hard material which has a transverse rupture strength usable as a tool and exhibits excellent high temperature oxidation resistance and a high temperature hardness without using a rare metal.

The hard sintered body of the present embodiment includes the binder phase and the hard phase, and it is thus desired that the raw material powders for the binder phase and the hard phase are homogeneously mixed in order to improve the mechanical properties and the like. In addition, it is preferable to obtain the raw material powders by mixing and pulverizing the powders in a dry or wet manner since the refinement of crystals in the hard phase and the binder phase is effective in improving the hardness and the like. By refinement in the mixing and pulverizing step, a new surface is generated in each of the raw material powders for the binder phase and the hard phase, and an oxygen molecule or the like adhere to this newly formed surface. For this reason, the mixed powder is necessarily oxidized although it is in a greater or less degree when the finely pulverized mixed powder is exposed to the atmospheric air.

In the present embodiment, at least one kind selected from $FeAl_2$, $Fe_2Al_5$ and $FeAl_3$ is used as the iron aluminide powder of the material for binder phase instead of conventional $Fe_3Al$ or FeAl. Oxygen adsorbed on the mixed powder that is refined by mixing and pulverization and aluminum excessively present with respect to iron in iron aluminide undergo the reaction represented by the following chemical reaction formulas (2) to (4) at a high temperature at the time of sintering to form a binder phase containing aluminum oxide and iron aluminide of sound FeAl as the main component. This aluminum oxide forms a fine crystal grain and is present by being dispersed in the binder phase.

$$4FeAl_2+3O_2 \rightarrow 4FeAl+2Al_2O_3 \quad (2)$$

$$4Fe_2Al_5+9O_2 \rightarrow 8FeAl_2+2Al_2O_3+6O_2 \rightarrow 8FeAl+6Al_2O_3 \quad (3)$$

$$4FeAl_3+6O_2 \rightarrow 4FeAl_2+2Al_2O_3+3O_2 \rightarrow 4FeAl+4Al_2O_3 \quad (4)$$

In order to disperse and mix powders in a submicrometer order, it may be required to mix the powders for a long time or to add a dispersant or the like thereto. However, as the conventional cemented carbide and cermet, the hard sintered body of the present embodiment can be manufactured by mixing, molding, and sintering an iron aluminide powder that is the material for binder phase and a material powder for hard phase. The method of mixing the binding particle powder that is the material for the binder phase and the hard particle powder that is the material for the hard phase may be a dry or wet method. In addition, the method of pulverizing the binding particle powder and the hard particle powder is not particularly limited. In the present embodiment, the oxygen content in the mixed powder is necessarily required to be controlled, thus the relationship between the mixing and pulverization time and the amount of oxygen contained in the mixed powder to be obtained is determined in advance through an experiment or the like, and the pulverization and mixing is conducted until a mixed powder containing a predetermined amount of oxygen of the target is obtained.

In the mixing and pulverizing step, it is possible to obtain a mixed powder by wet mixing and pulverizing the binding particle powder and the hard particle powder by using an organic solvent and a wet mixing and pulverizing machine such as a rolling ball mill, a planetary ball mill, or an attritor until a mixed powder containing a predetermined amount of oxygen is obtained. In addition, it is also possible to obtain a mixed powder by dry mixing and pulverizing the binding particle powder and the hard particle powder in a mill vessel in a vacuum or a mill vessel purged with argon or nitrogen and then exposing a mixed powder thereof to the atmospheric air by using a dry mixing and pulverizing machine such as a rolling ball mill, a planetary ball mill, or an attritor until the mixed powder containing a predetermined amount of oxygen is obtained.

In the present embodiment, the mixed powder which is obtained by mixing and pulverizing the binding particle powder and the hard particle powder and contains a predetermined amount of oxygen is filled in a metal mold, pressure molded, and sintered to manufacture a hard sintered body. The sintering is preferably conducted in a vacuum atmosphere, an argon atmosphere, a nitrogen atmosphere, or a hydrogen atmosphere. Instead of this method, the mixed powder which is obtained by mixing and pulverizing the binding particle powder and the hard particle powder and contains a predetermined amount of oxygen may be filled in a mold for electric current pressure sintering apparatus and sintered in a vacuum atmosphere, an argon atmosphere, a nitrogen atmosphere, or a hydrogen atmosphere by being electrically heated while pressurizing the mold. Furthermore, these sintered bodies thus obtained may be subjected to the HIP treatment if necessary.

The binder phase of the hard sintered body of the present embodiment thus manufactured is a sound FeAl phase in which fine aluminum oxide is dispersed. For this reason, in a high temperature oxidizing atmosphere, the surface exposed to the atmospheric air of the FeAl phase of the hard sintered body is newly oxidized, and an aluminum oxide film is formed on the surface of the hard sintered body. This aluminum oxide film covers the surface of the hard sintered body and prevents diffusion of oxygen into the interior of the hard sintered body. For this reason, the hard sintered body of the present embodiment exhibits extremely excellent high temperature oxidation resistance. In addition, the hard sintered body of the present embodiment has a high hardness at a high temperature since aluminum oxide also contributes to the improvement in hardness.

EXAMPLES

Hereinafter, the present invention will be specifically described based on Examples, but the present invention is not limited by the following Examples at all.

First, the respective raw material powders were mixed so that the blended compositions presented in Table 1 were obtained by using a commercially available TiC powder having an average particle size of 1.7 μm (manufactured by JAPAN NEW METALS CO., LTD.), a TiCN powder having an average particle size of 1.4 μm (manufactured by JAPAN NEW METALS CO., LTD., $TiC_{07}N_{03}$), a WC powder having an average particle size of 0.73 μm (manufactured by JAPAN NEW METALS CO., LTD.), a WC powder having an average particle size of 0.92 μm (manufactured by A.L.M.T. Corp.), a TiN powder having an average particle size of 1.3 μm (manufactured by JAPAN NEW METALS CO., LTD.), an FeAl powder having an average particle size of 10 μm (manufactured by KCM Corporation (Fe: 40 mol %, Al: 60 mol %)), a ferroaluminum powder having a particle size of 300 μm or less (manufactured by shoei shokai co., ltd. (Fe: 33 mol %, Al: 67 mol %)), an Fe powder having a particle size of from 3 to 5 μm (manufactured by KOJUNDO CHEMICAL LABORATORY CO., LTD.), a Ni powder having an average particle size of 5.5 μm (manufactured by KOJUNDO CHEMICAL LABORATORY CO., LTD.), an $\alpha$-$Al_2O_3$ powder having an average particle size of 0.3 μm (manufactured by KOJUNDO CHEMICAL LABORATORY CO., LTD.), a $Mo_2C$ powder having an average particle size of 1.8 μm (manufactured by KOJUNDO CHEMICAL LABORATORY CO., LTD.), a Cr powder having a particle size of from 63 to 90 μm (manufactured by KOJUNDO CHEMICAL LABORATORY CO., LTD.), an FeB powder having an average particle size of 63 μm (manufactured by NIPPON DENKO CO., LTD.), and a B powder having an average particle size of 45 μm (manufactured by KOJUNDO CHEMICAL LABORATORY CO., LTD.) as raw materials. A1 to A23 are Examples of the present invention, and B1 to B3 are Comparative Examples.

TABLE 1

| Sample | Blended composition (mol %) | | | | | | | | | | | | | | Sintering temperature (° C.) |
|---|---|---|---|---|---|---|---|---|---|---|---|---|---|---|---|
| | TiC | TiCN | WC having an average particle size of 0.73 μm | WC having an average particle size of 0.92 μm | TiN | FeAl | $FeAl_2$ | Fe | Ni | $Al_2O_3$ | $Mo_2C$ | Cr | FeB | B | |
| A1 | 92.1 | — | — | — | — | — | 7.9 | — | — | — | — | — | — | — | 1280 |
| A2 | 89.2 | — | — | — | — | — | 10.8 | — | — | — | — | — | — | — | 1280 |
| A3 | 86.1 | — | — | — | — | — | 13.9 | — | — | — | — | — | — | — | 1280 |
| A4 | 82.8 | — | — | — | — | — | 17.2 | — | — | — | — | — | — | — | 1280 |
| A5 | 75.6 | — | — | — | — | — | 24.4 | — | — | — | — | — | — | — | 1280 |
| A6 | — | 97.6 | — | — | — | — | 2.4 | — | — | — | — | — | — | — | 1280 |
| A7 | — | 95.0 | — | — | — | — | 5.0 | — | — | — | — | — | — | — | 1260 |
| A8 | — | 92.3 | — | — | — | — | 7.7 | — | — | — | — | — | — | — | 1240 |
| A9 | — | 89.4 | — | — | — | — | 10.6 | — | — | — | — | — | — | — | 1240 |
| A10 | — | 86.4 | — | — | — | — | 13.6 | — | — | — | — | — | — | — | 1280 |
| A11 | — | — | — | — | 86.9 | — | 13.1 | — | — | — | — | — | — | — | 1260 |
| A12 | 78.2 | — | — | — | — | — | 12.6 | — | — | — | — | 9.2 | — | — | 1240 |
| A13 | — | 78.5 | — | — | — | — | 12.4 | — | — | — | — | 9.1 | — | — | 1240 |
| A14 | 86.1 | — | — | — | — | — | 13.9 | — | — | — | — | — | — | — | 1280 |
| A15 | — | 81.4 | — | — | — | — | 9.6 | 9.0 | — | — | — | — | — | — | 1260 |
| A16 | — | 84.6 | — | — | — | 5.4 | 10.0 | — | — | — | — | — | — | — | 1280 |
| A17 | — | 86.4 | — | — | — | — | 13.6 | — | — | — | — | — | — | — | 1280 |
| A18 | — | 85.6 | — | — | — | — | 13.1 | — | — | — | — | — | 1.3 | — | 1240 |
| A19 | — | 86.2 | — | — | — | — | 13.6 | — | — | — | — | — | — | 0.2 | 1220 |
| A20 | — | — | 85.7 | — | — | — | 14.3 | — | — | — | — | — | — | — | 1280 |
| A21 | — | — | — | 85.7 | — | — | 14.3 | — | — | — | — | — | — | — | 1280 |
| A22 | — | — | 85.1 | — | — | — | 13.7 | — | — | — | — | | 1.2 | | 1180 |
| A23 | — | — | 85.6 | — | — | — | 14.2 | — | — | — | — | — | — | 0.2 | 1180 |
| B1 | — | 61.5 | — | — | — | — | — | — | 26.7 | — | 11.8 | — | — | — | 1450 |
| B2 | 80.2 | — | — | — | — | 13.8 | — | — | — | 6.0 | — | — | — | — | 1320 |
| B3 | 75.2 | — | — | — | — | 24.8 | — | — | — | — | — | — | — | — | 1240 |

Next, the mixed powders of A1 to A23, B1, and B3 were subjected to wet mixing and pulverization using acetone as a solvent by a rolling type ball mill. Wet mixing and pulverization was conducted for 120 hours for A5 and A14, 108 hours for A17 and A21, 48 hours for B1, and 72 hours for the others. Dry mixing and pulverization was conducted for 1 hour for B2. Thereafter, the powders subjected to wet mixing and pulverization were dried to obtain mixed powders, and the powder subjected to dry mixing and pulverization was used as it was to obtain a mixed powder.

Next, the mixed powders of A1 to A23, B2, and B3 thus obtained were each filled in a graphite mold. The powder-filled graphite mold was placed in a pulsed electric current sintering furnace and retained at about from 1150° C. to 1300° C. for from 10 minutes to 20 minutes while applying a pressure of 40 MPa to the graphite mold to conduct sintering. In addition, in the mixed powder of B1, the mixed powder was filled in a metal mold and pressure molded by applying a pressure of 100 MPa to the metal mold by using a hand press, then sintered at 1415° C. for 2 hours by using a vacuum sintering furnace. Thereafter, the plane of the hard sintered bodies thus obtained was ground and then polished until the surface became a mirror surface, and the density, Vickers hardness (HV 30), fracture toughness, and transverse rupture strength of the hard sintered bodies were measured, respectively. The measurement results are presented in Table 2. Incidentally, the Vickers hardness was measured by a method conforming to JIS Z 2244, and the fracture toughness was calculated based on the following Shetty's equation.

$$K_{IC} = 1.39 \times \sqrt{\frac{H_V \cdot P}{C}} \quad \text{[Formula 1]}$$

where, $H_v$ denotes the Vickers hardness (GPa), P denotes the indentation load (N), and C denotes the average crack length (μm).

TABLE 2

| Sample | Density g $cm^{-3}$ | Vickers hardness kgf $mm^{-2}$ | Fracture toughness MPa · $m^{0.5}$ | Transverse rupture strength MPa |
|---|---|---|---|---|
| A1 | 5.00 | 1995 | 7.0 | 1981 |
| A2 | 4.80 | 1708 | 7.5 | 1406 |

TABLE 2-continued

| Sample | Density g $cm^{-3}$ | Vickers hardness kgf $mm^{-2}$ | Fracture toughness MPa · $m^{0.5}$ | Transverse rupture strength MPa |
|---|---|---|---|---|
| A3 | 4.90 | 1662 | 8.1 | 1387 |
| A4 | 4.80 | 1730 | 6.8 | 1695 |
| A5 | 4.83 | 1824 | 6.8 | 1175 |
| A6 | 5.21 | 1851 | 6.5 | 1392 |
| A7 | 5.18 | 1846 | 6.2 | 1625 |
| A8 | 5.15 | 1669 | 6.4 | 1983 |
| A9 | 5.16 | 1527 | 6.9 | 1753 |
| A10 | 5.00 | 1755 | 6.6 | 1746 |
| A11 | 5.20 | 1409 | 7.6 | 1269 |
| A12 | 5.02 | 1685 | 7.0 | 1368 |
| A13 | 5.21 | 1505 | 6.9 | 1165 |
| A14 | 4.97 | 1847 | 7.1 | 1269 |
| A15 | 5.21 | 1507 | 7.0 | 1689 |
| A16 | 5.17 | 1509 | 6.4 | 1663 |
| A17 | 5.13 | 1699 | 8.4 | 2162 |
| A18 | 5.11 | 1687 | 8.4 | 1731 |
| A19 | 5.11 | 1681 | 7.8 | 1866 |
| A20 | 12.68 | 1975 | 12.1 | 2348 |
| A21 | 12.99 | 1880 | 11.3 | 2124 |
| A22 | 12.58 | 1780 | 7.8 | 1601 |
| A23 | 12.47 | 1952 | 8.5 | 1962 |
| B1 | 6.38 | 1298 | 10.2 | 1805 |
| B2 | 4.76 | 1562 | 6.6 | 526 |
| B3 | 5.15 | 1793 | 7.8 | 1593 |

Next, the hard sintered bodies of A2 to A4, A7, A9 to A13, A15, and B1 to B3 were subjected to a high temperature oxidation resistance test at 800° C. in the atmospheric air. The weight was measured after cooling the sample to room temperature for every elapsed time, and the temperature of the sample was then raised to 800° C. again. The cumulative oxidation weight gain (unit: $g/m^2$) is presented in Table 3.

TABLE 3

Unit: $g/m^2$

| Sample | After 4 hours | After 8 hours | After 12 hours | After 16 hours | After 24 hours | After 48 hours | After 72 hours |
|---|---|---|---|---|---|---|---|
| A2 | 2.55 | 3.63 | 4.31 | 4.77 | 5.52 | 6.97 | 7.99 |
| A3 | 2.19 | 2.72 | 2.89 | 3.23 | 3.59 | 4.29 | 4.76 |
| A4 | 2.42 | 3.49 | 4.04 | 4.41 | 4.80 | 5.74 | 6.18 |
| A7 | 4.38 | 5.92 | 6.84 | 7.30 | 8.84 | 11.41 | 13.66 |
| A9 | 4.08 | 5.30 | 5.97 | 6.32 | 6.98 | 8.21 | 9.06 |
| A10 | 1.91 | 2.57 | 2.63 | 2.82 | 3.06 | 3.68 | 4.00 |
| A11 | 4.99 | 5.40 | 5.72 | 6.25 | 7.60 | 13.12 | 16.30 |
| A12 | 8.49 | 11.84 | 13.96 | 15.88 | 18.96 | 25.22 | 30.16 |
| A13 | 4.55 | 7.73 | 9.82 | 11.76 | 14.34 | 15.10 | 16.64 |
| A15 | 2.92 | 5.07 | 6.66 | 7.80 | 9.79 | 13.99 | 18.65 |
| B1 | 4.51 | 6.28 | 7.67 | 8.84 | 10.28 | 13.65 | 15.76 |
| B2 | 10.16 | 20.11 | 27.52 | 35.35 | 46.70 | 71.16 | 94.12 |
| B3 | 8.84 | 12.24 | 14.30 | 16.06 | 18.30 | 23.41 | 26.55 |

B1 (cermet) of Comparative Example is known as a material exhibiting excellent high temperature oxidation resistance. The cumulative oxidation weight gain of A2 to A4 was about from 30 to 60% and the cumulative oxidation weight gain of A10 was 25.4% or less as compared to the cumulative oxidation weight gain of B1, and these samples thus exhibited significantly excellent high temperature oxidation resistance. In addition, A10 and A17 were subjected to a oxidation resistance test at 800° C. continuously for 72 hours in the atmospheric air, and A10 and A17 exhibited excellent oxidation resistance as the oxidation weight gain (unit: $g/m^2$) was 3.3 for A10 and 4.0 for A17.

The cross section of the sample after the high temperature oxidation test was subjected to energy dispersive X-ray spectrometry. FIG. 1 illustrates the results for observation (SEM) of the cross section of a hard sintered body of A3 after the high temperature oxidation test and energy dispersive X-ray spectrometric analysis (illustrating distribution of elements) of each element (Ti, Fe, Al and O). The left side of the image is the face exposed to the atmospheric air, and it has been found from the image taken by a SEM that an aluminum oxide film having a thickness of about 2 μm is formed on the iron aluminide surface of the binder phase by oxidation. In addition, the concentration at the part surrounded by the curve on the left side of the image is high when the images of Al and O analyzed are observed. This indicates that an aluminum oxide film is formed on the surface of A3 during the high temperature oxidation test and oxidation into the interior is less likely to occur by this.

Figure 2:
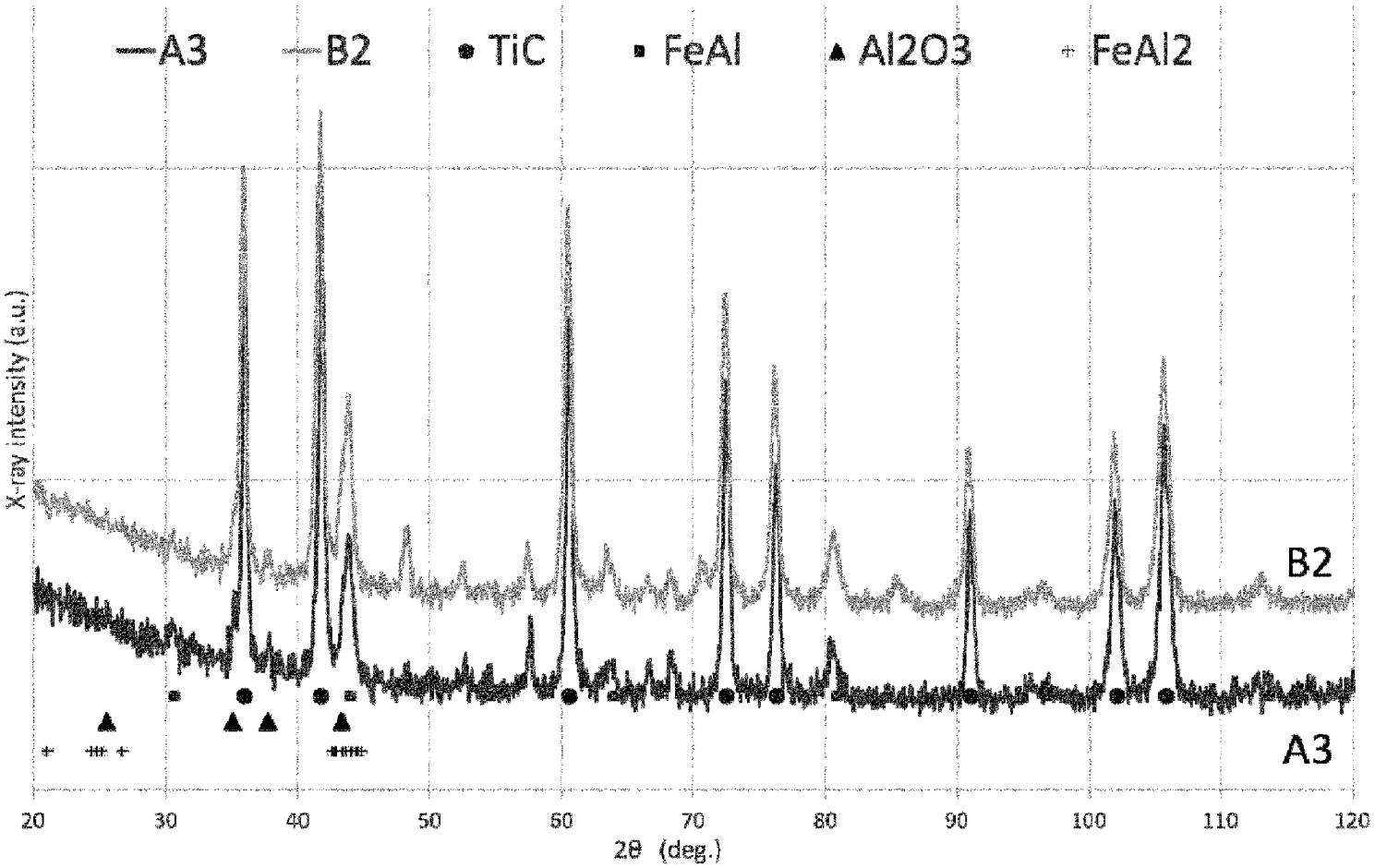
FIG. 2 is X-ray diffraction patterns of the hard sintered body of A3 of Example and a hard sintered body of B2 of Comparative Example.
Figure 3:
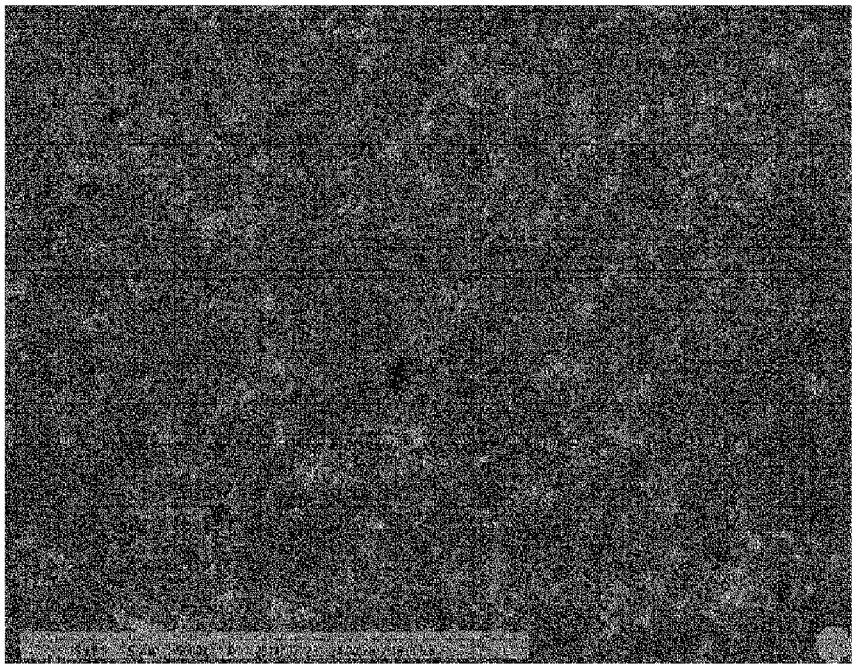
FIG. 3 is an image of a hard sintered body of A2 of Example observed through a scanning electron microscope.

On the other hand, the hard sintered body of A3 was superior when the high temperature oxidation resistance of the hard sintered body of A3 was compared to that of the hard sintered body of B2 of Comparative Example which was adjusted to have the same composition as that of the hard sintered body of A3. Hence, in order to compare the hard sintered bodies of A3 and B2 to each other, analysis of constituent phases by X-ray diffraction and observation through a scanning electron microscope (SEM) were conducted. The X-ray diffraction patterns of the hard sintered bodies of A3 and B2 are illustrated in FIG. 2. As the raw material for the binder phase, $FeAl_2$ was used in A3 and FeAl and $Al_2O_3$ were used in B3, but peaks attributed to TiC, FeAl, and $Al_2O_3$ were observed but a peak attributed to $FeAl_2$ was not observed in both the hard sintered bodies of A3 and B2.

In other words, it has been found that the constituent phases of A3 and B2 contain TiC, FeAl, and $Al_2O_3$ but do not contain $FeAl_2$. From this fact, it is indicated that FeAl and $Al_2O_3$ are produced from $FeAl_2$ in A3 by the method of manufacturing a hard sintered body of the present invention.

Figure 4:
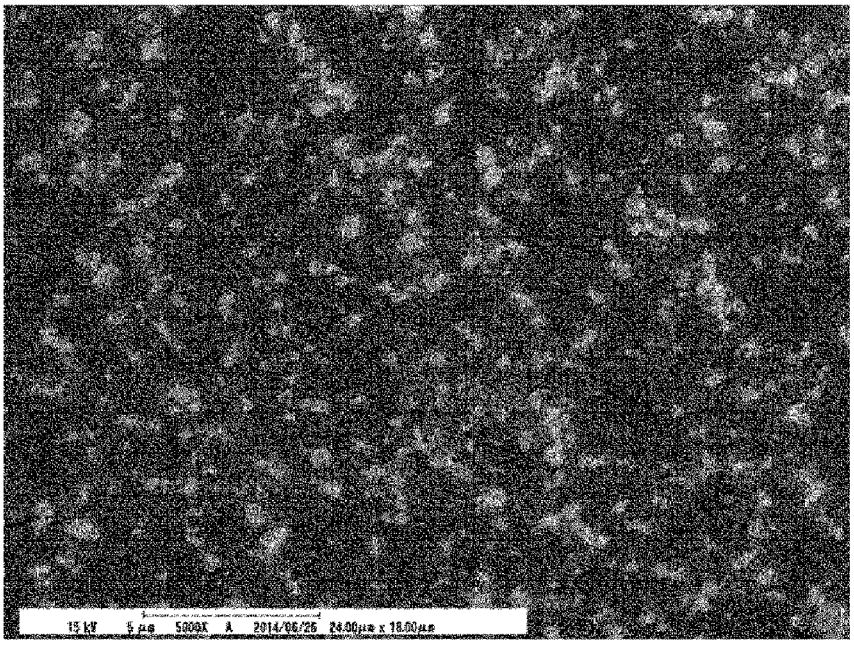
FIG. 4 is an image of the hard sintered body of A3 of Example observed through a scanning electron microscope.
Figure 5:
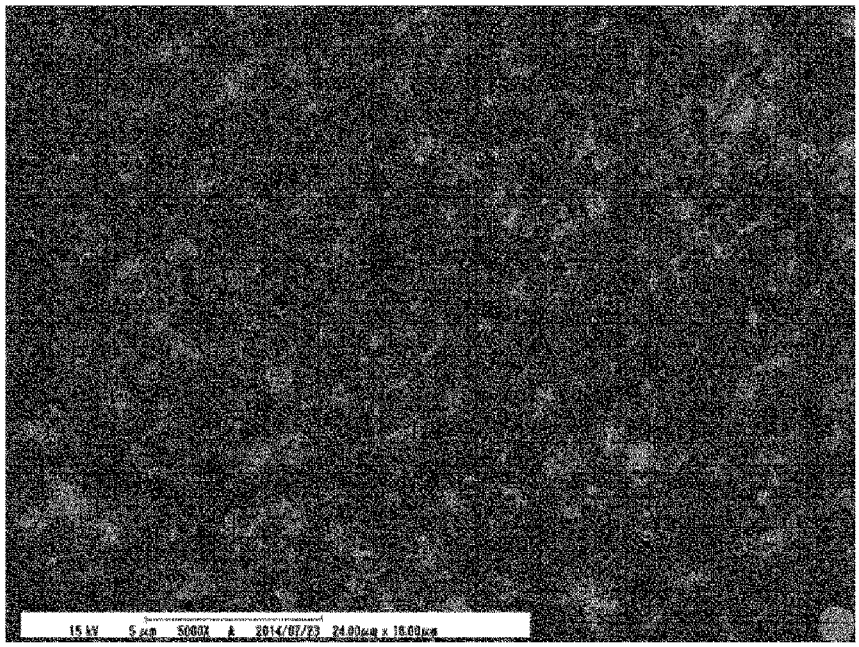
FIG. 5 is an image of a hard sintered body of A4 of Example observed through a scanning electron microscope.
Figure 6:
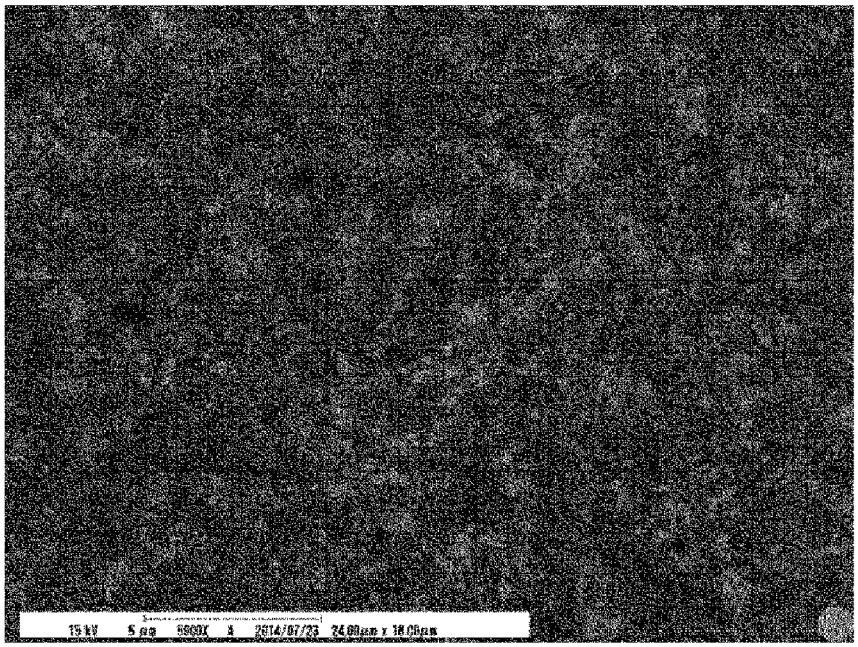
FIG. 6 is an image of a hard sintered body of A5 of Example observed through a scanning electron microscope.
Figure 7:
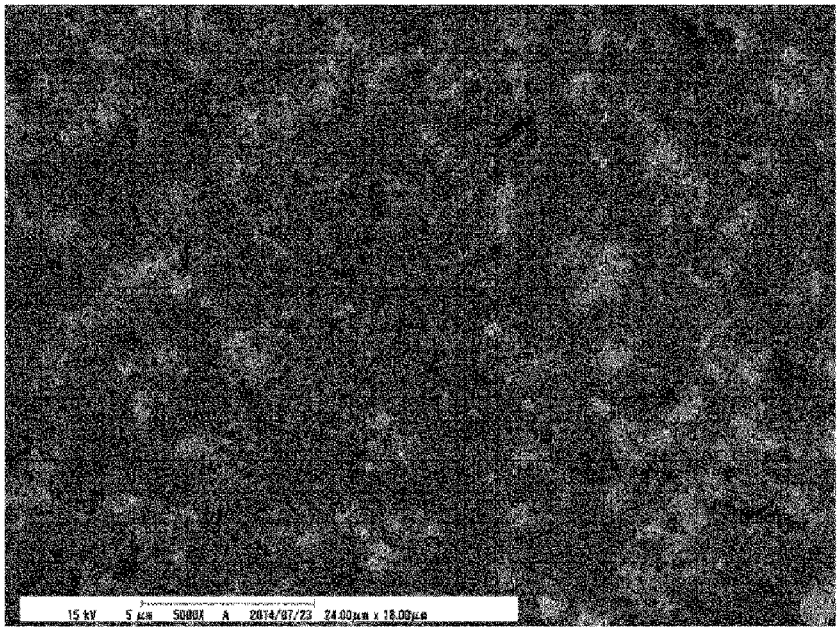
FIG. 7 is an image of a hard sintered body of A10 of Example observed through a scanning electron microscope.
Figure 8:
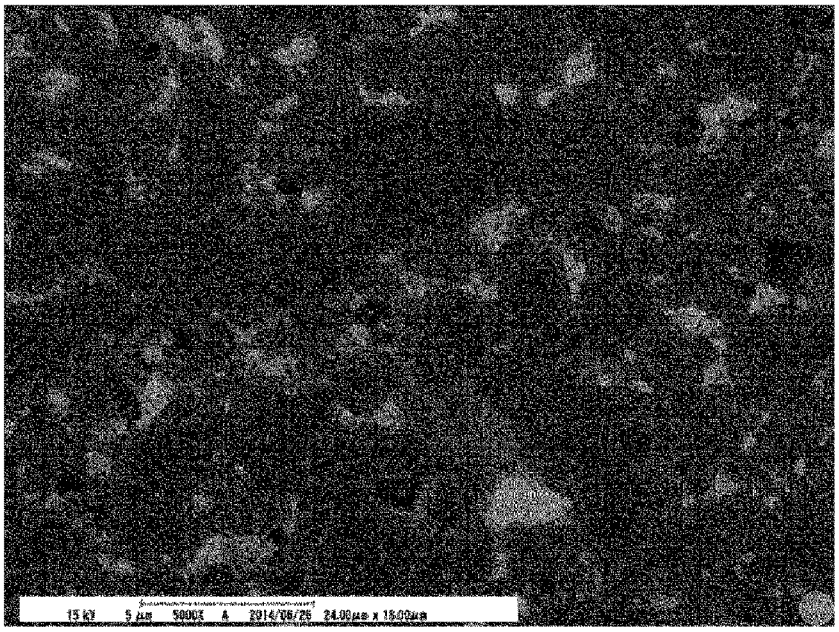
FIG. 8 is an image of a hard sintered body of B2 of Comparative Example observed through a scanning electron microscope.

FIGS. 3 to 8 illustrate the images of the hard sintered bodies of A2 to A5, A10, and B2 observed through a SEM at a 5000-fold magnification. A circle having a diameter of 1 μm is drawn on the lower right of the images. The white large and small spots in the drawings indicate $Al_2O_3$. As illustrated in FIG. 4, the outer diameter of any white spot is 1 μm or less in the hard sintered body of A3, but a white spot having an outer diameter of 1 μm or more is observed in the hard sintered body of B2 as illustrated in FIG. 8. It is considered that the $Al_2O_3$ powder coarsened due to aggregation or the like in the sintering step in the hard sintered body of B2 since the particle size of the $Al_2O_3$ powder that is the raw material for B2 is 0.3 μm.

Figure 9:
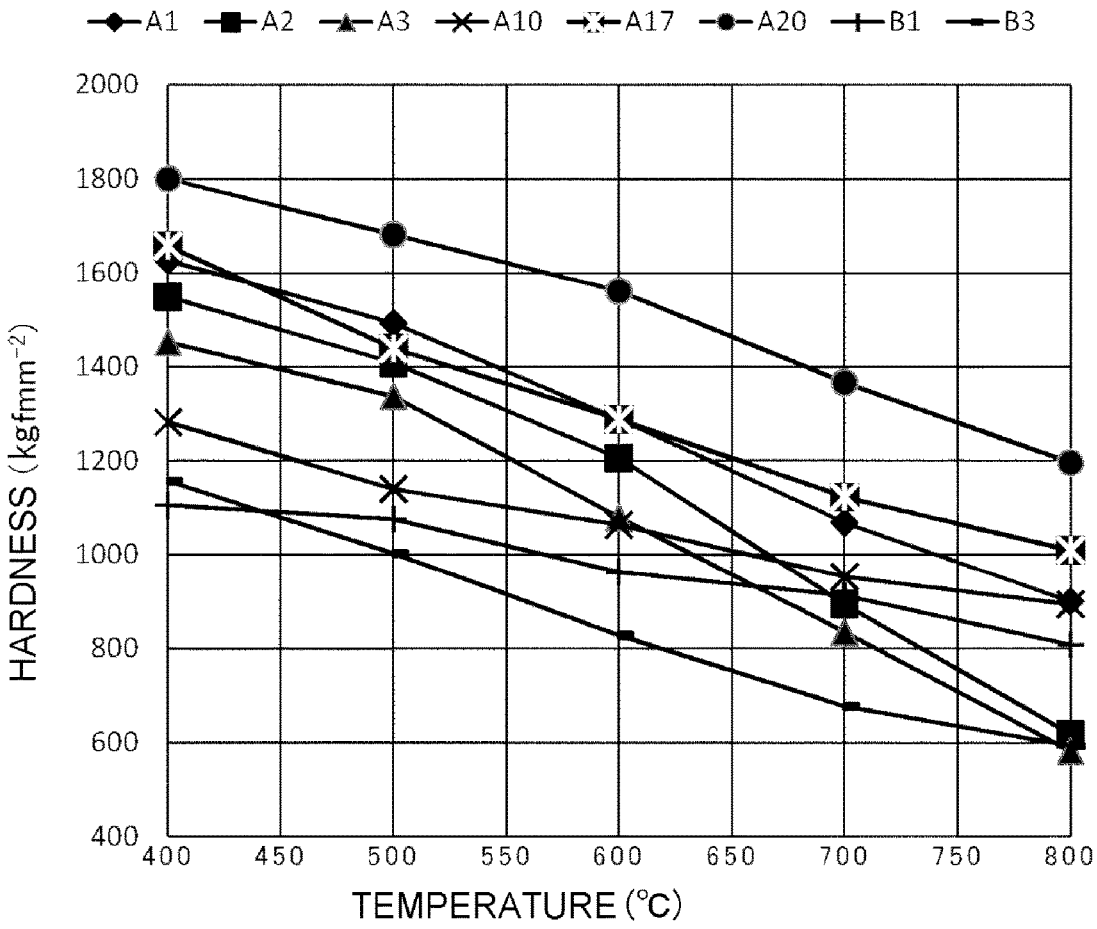
FIG. 9 is a graph illustrating the results for a high temperature hardness test of hard sintered bodies of A1 to A3, A10, A17, and A20 of Examples and hard sintered bodies of B1 and B3 of Comparative Examples at from 400 to 800° C.

Next, the hardness (unit: kgf $mm^{-2}$) at a high temperature was measured for the samples which exhibited an excellent result in the high temperature oxidation resistance test. The hardness was measured by a method conforming to JIS Z2244. In other words, each sample was heated up to 800° C. and then left until the temperature was stabilized, the Vickers indenter was then brought into contact with the sample surface and heated until the temperature of the indenter reached the sample temperature, and the pressure was dropped at a test load of 10 kgf for 15 seconds to conduct the measurement. It was repeatedly conducted that the temperature was decreased by 100° C. after the measurement for several points and the hardness was measured in the same manner as in the prior time until the sample temperature reached 400° C. The measurement results are presented in Table 4 and illustrated in FIG. 9.

TABLE 4

| Sample | 400° C. | 500° C. | 600° C. | 700° C. | 800° C. |
|---|---|---|---|---|---|
| | | | | | Unit: kgf $mm^{-2}$ |
| A1 | 1627 | 1492 | 1288 | 1069 | 900 |
| A2 | 1549 | 1408 | 1206 | 894 | 618 |
| A3 | 1452 | 1337 | 1080 | 835 | 582 |
| A10 | 1282 | 1140 | 1064 | 953 | 894 |
| A17 | 1658 | 1439 | 1288 | 1123 | 1010 |
| A20 | 1800 | 1682 | 1561 | 1366 | 1196 |
| B1 | 1106 | 1076 | 963 | 913 | 808 |
| B3 | 1157 | 1003 | 828 | 677 | 593 |

The high-temperature hardness of the hard sintered body of A1 having few binder phases, the hard sintered bodies of A10 and A17, and the hard sintered body of A20 containing tungsten carbide as a main component was higher than the hardness of the hard sintered body (cermet) of B1 of Comparative Example at all temperatures. In addition, the hardness of the hard sintered bodies of A2 and A3 was higher than the hardness of the cermet at a temperature of 600° C. or lower. In addition, when the hardness of the hard sintered bodies of A3 and B3 having an equivalent amount of binder phase was compared to each other, the hardness was equivalent at 800° C. but the hardness of the hard sintered body of A3 was higher than that of the hard sintered body of B3 at 700° C. or lower. Furthermore, when the hardness of the hard sintered bodies of A10 and A17 and B3 having an equivalent amount of binder phase was compared to the hardness of the hard sintered body of B3, the hardness of the hard sintered bodies of A10 and A17 was higher than the hardness of the hard sintered body of B3 at all temperatures.

The actually measured value of the amount of oxygen in the hard sintered body of each sample and the theoretically calculated values of the compositions of the hard sintered body and binder phase of each sample calculated from the blended composition of the mixed powder are presented in Table 5. The amount of oxygen in the hard sintered body was measured by using an oxygen and nitrogen analyzer (TC-436 manufactured by LECO Corporation). For example, the composition of the hard sintered body of A2 and the composition of the binder phase were calculated as follows. From Table 5, 100 g of the hard sintered body of A2 is composed of 95.94 g of the mixed powder and 4.06 g of oxygen. When the atomic weight of oxygen is denoted as AtmO, MolO which denotes the substance amount of oxygen contained in 100 g of the hard sintered body is as follows.

$$MolO=4.06/AtmO\ [mol]$$

Since oxygen in the hard sintered body is all oxygen in $Al_2O_3$ and the substance amount of $Al_2O_3$ in the hard sintered body is ⅓ of the substance amount of oxygen in the hard sintered body, $MolAl_2O_3$ which denotes the substance amount of $Al_2O_3$ contained in 100 g of the hard sintered body is as follows.

$$MolAl_2O_3=⅓\times(4.06/AtmO)\ [mol]$$

On the other hand, when the formula weight of TiC is denoted as AtmTiC and the formula weight of $FeAl_2$ is denoted as Atm $FeAl_2$, the mass of TiC contained in 95.94 g of the mixed powder, namely, the mass of TiC contained in 100 g of the hard sintered body is $$\text{mass of TiC in 100 g of hard sintered body}=95.94\times 0.892\times AtmTiC/(0.892\times AtmTiC+0.108\times Atm\text{-}FeAl_2)\ [g]$$

from Table 1.

Hence, since MolTiC which denotes the substance amount of TiC contained in 100 g of the hard sintered body is a value obtained by dividing the mass of TiC in 100 g of the hard sintered body by the formula weight AtmTiC of TiC, it is as follows.

$$MolTiC=95.94\times 0.892/(0.892\times AtmTiC+0.108\times Atm\text{-}FeAl_2)\ [mol]$$

In addition, as presented in the chemical reaction formula (2), MolFeAl which denotes the substance amount of FeAl contained in 100 g of the hard sintered body is the same as $MolFeAl_2$ which denotes the substance amount of $FeAl_2$ contained in 95.94 g of the mixed powder, and it is thus as follows in the same manner as the calculation of MolTiC.

$$MolFeAl=95.94\times 0.108/(0.892\times AtmTiC+0.108\times Atm\text{-}FeAl_2)\ [mol]$$

The mole fraction of TiC, the mole fraction of FeAl, and the mole fraction of $Al_2O_3$ in hard sintered body are each as follows.

$$\text{Mole fraction of TiC in hard sintered body}=MolTiC/(MolTiC+MolFeAl+MolAl_2O_3)$$

$$\text{Mole fraction of FeAl in hard sintered body}=MolFeAl/(MolTiC+MolFeAl+MolAl_2O_3)$$

$$\text{Mole fraction of } Al_2O_3 \text{ in hard sintered body}=MolAl_2O_3/(MolTiC+MolFeAl+MolAl_2O_3)$$

The values of MolTiC, MolFeAl, and $MolAl_2O_3$ calculated by the formulas described above were substituted into the above formulas to calculate the mole fraction of TiC, the mole fraction of FeAl, and the mole fraction of $Al_2O_3$.

In addition, since $MolAl@Al_2O_3$ which denotes the substance amount of Al in $Al_2O_3$ contained in 100 g of the hard sintered body is 2-fold the substance amount $MolAl_2O_3$ of $Al_2O_3$ contained in 100 g of the hard sintered body, it is as follows.

$$MolAl@Al_2O_3=2\times MolAl_2O_3\ [mol]$$

The substance amount of Al in iron aluminide contained in 100 g of the hard sintered body, namely MolAl@FeAl which denotes the substance amount of Al contained in 100 g of the hard sintered body excluding Al in $Al_2O_3$ is $$MolAl@FeAl=2\times MolAl@FeAl_2-MolAl@Al_2O_3=2\times MolAl@FeAl_2-2\times MolAl_2O_3\ [mol]$$

when $MolAl@FeAl_2$ which denotes the substance amount of Al in $FeAl_2$ contained in 95.94 g of the mixed powder is used. Here, since it is $MolAl@FeAl_2=2\times MolFeAl_2$ [mol], MolAl@FeAl was calculated by substituting the value of $MolAl_2O_3$ calculated by the formula described above and the value of $MolFeAl_2$ at the time of blending the mixed powder into the above formula.

Moreover, since the mole fraction of Al in iron aluminide in 100 g of the hard sintered body, namely the mole fraction of Al in iron aluminide in the binder phase is a value obtained by dividing the substance amount of Al in iron aluminide in 100 g of the hard sintered body by the sum of the substance amount of iron aluminide in 100 g of the hard sintered body, namely the substance amount of $FeAl_2$ contained in 95.94 g of the mixed powder and the substance amount of Al in iron aluminide in 100 g of the hard sintered body, it is as follows.

$$\text{Mole fraction of Al in iron aluminide in binder phase}=MolAl@FeAl/(MolAl@FeAl+MolFeAl_2)$$

The mole fraction of Al in iron aluminide in the binder phase was calculated by substituting the value of MolAl@FeAl calculated by the formula described above and the value of $MolFeAl_2$ at the time of blending the mixed powder into the above formula.

In addition, since the mole fraction of $Al_2O_3$ in the binder phase in 100 g of the hard sintered body, namely the mole fraction of $Al_2O_3$ in the binder phase is a value obtained by dividing the substance amount $MolAl_2O_3$ of $Al_2O_3$ contained in 100 g of the hard sintered body by the sum of the substance amount of iron aluminide contained in 100 g of the hard sintered body, namely the substance amount of $FeAl_2$ contained in 95.94 g of the mixed powder and the substance amount $MolAl_2O_3$ of $Al_2O_3$ contained in 100 g of the hard sintered body, it is as follows.

$$\text{Mole fraction of } Al_2O_3 \text{ in binder phase} = MolAl_2O_3/(MolFeAl_2+MolAl_2O_3)$$

The mole fraction of $Al_2O_3$ in the binder phase was calculated by substituting the value of $MolAl_2O_3$ calculated by the formula described above and the value of $MolFeAl_2$ at the time of blending the mixed powder into the above formula.

The compositions of hard sintered bodies and binder phases of A3, A4, A10, A14, and B2 were also calculated in the same manner. Incidentally, the actually measured oxygen is considered to be bonded to Al from the results for energy dispersive X-ray spectroscopic measurement illustrated in FIG. 1 and the results for X-ray diffraction pattern illustrated in FIG. 2.

TABLE 5

| Sample | Actually measured value of hard sintered body O Mass % | Composition of hard sintered body (theoretically calculated value, mol %) Hard phase TiC | TiCN | WC | Binder phase FeAl | Fe | $Al_2O_3$ | Sum | Composition of binder phase (theoretically calculated value, mol %) $Al_2O_3$ in binder phase | Al in iron aluminide |
|---|---|---|---|---|---|---|---|---|---|---|
| A1 | 4.4 | 86.8 | — | — | 7.4 | — | 5.8 | 13.2 | 43.9 | 30.2 |
| A2 | 3.4 | 85.2 | — | — | 10.3 | — | 4.5 | 14.8 | 30.6 | 52.8 |
| A3 | 3.4 | 82.1 | — | — | 13.3 | — | 4.7 | 17.9 | 26.1 | 56.4 |
| A4 | 3.7 | 78.5 | — | — | 16.3 | — | 5.2 | 21.5 | 24.2 | 57.7 |
| A5 | 8.5 | 65.6 | — | — | 22.1 | — | 12.3 | 34.4 | 35.9 | 46.9 |
| A6 | 2.9 | — | 95.3 | — | — | 2.3 | 2.3 | 4.7 | 50.0 | 0.0 |
| A7 | 3.1 | — | 91.2 | — | 4.8 | — | 4.0 | 8.8 | 45.6 | 24.6 |
| A8 | 3.2 | — | 88.4 | — | 7.4 | — | 4.3 | 11.6 | 36.6 | 45.8 |
| A9 | 3.5 | — | 85.2 | — | 10.1 | — | 4.7 | 14.8 | 31.8 | 51.6 |
| A10 | 4.2 | — | 81.3 | — | 12.8 | — | 5.8 | 18.7 | 31.2 | 52.3 |
| A14 | 6.3 | 78.7 | | — | 12.7 | — | 8.6 | 21.3 | 40.4 | 39.2 |
| A15 | 4.5 | — | 84.0 | — | 10.0 | — | 6.0 | 16.0 | 37.7 | 44.1 |
| A16 | 4.7 | — | 83.7 | — | 9.9 | — | 6.3 | 16.3 | 39.0 | 42.0 |
| A17 | 5.7 | — | 79.6 | — | 12.6 | — | 7.9 | 20.4 | 38.4 | 42.9 |
| A20 | 2.4 | — | — | 78.5 | 13.0 | — | 8.5 | 21.5 | 39.4 | 41.1 |
| A21 | 1.7 | — | — | 80.4 | 13.4 | — | 6.2 | 19.6 | 31.8 | 51.6 |
| B2 | 4.4 | 80.2 | — | — | 13.7 | — | 6.1 | 19.8 | 30.8 | 39.7 |
| B3 | 3.2 | 72.1 | — | — | 23.8 | — | 4.2 | 27.9 | 15.0 | 23.9 |

In B2, the binding particle powder and the hard particle powder were mixed and pulverized in a dry manner, and the mixed powder after the mixing and pulverizing step is thus not affected by oxidation. The theoretically calculated value of the composition of the hard sintered body of B2 showed approximately the same tendency as the blended composition of the mixed powder of B2 although it was slightly different therefrom. As presented in Table 5, the content of Al in iron aluminide was from 9.56 to 57.68% and the content of $Al_2O_3$ in the binder phase was from 24.16 to 60.91 mol %. The oxidation taken place at the time of the mixing and pulverizing process of iron aluminide and the hard material has been hitherto thought to be adversely affective, but a hard sintered body which exhibits significantly excellent high temperature oxidation resistance and has a high temperature hardness was obtained by actively utilizing this oxidation in the present invention.

INDUSTRIAL APPLICABILITY

The hard sintered body of the present invention can be used as a raw material for cutting tools, wear-resistant tools, corrosion-resistant members, high temperature members, and the like in which cemented carbide and cermet have been used so far. Specifically, it can be suitably used as a material for cutting tools for machining of difficult-to-cut materials to be exposed to a high temperature and high temperature forging and a material for wear-resistant tools.

The invention claimed is:

1. A hard sintered body consisting of a binder phase at from 8.8 to 34.4 mol % and the balance being a hard phase and unavoidable impurities, wherein the binder phase contains iron aluminide containing FeAl as a main component and alumina that is dispersed in the iron aluminide and has a particle size of 1 μm or less, and optionally contains at least one selected from the group consisting of boron, silicon, chromium, niobium and molybdenum, and the hard phase includes at least one selected from the group consisting of carbide of Ti, nitride of Ti, carbonitride of Ti, boride of Ti, and solid solutions thereof, and optionally includes at least one selected from the group consisting of tungsten carbide and a solid solution of tungsten carbide.

2. The hard sintered body according to claim 1, wherein the hard phase includes the at least one selected from the group consisting of tungsten carbide and a solid solution of tungsten carbide.

3. The hard sintered body according to claim 1, wherein the binder phase contains the at least one selected from the group consisting of boron, silicon, chromium, niobium and molybdenum.

4. The hard sintered body according to claim 1, wherein a content of the alumina in the binder phase is from 24.2 to 50.0 mol %.

5. The hard sintered body according to claim 1, wherein a content of aluminum in iron aluminide in the binder phase is from 24.6 to 57.7 mol %.

6. A cutting or wear-resistant tool comprising the hard sintered body according to claim 1 as a raw material.

7. A hard sintered body consisting of a binder phase at from 8.8 to 34.4 mol % and the balance being a hard phase and unavoidable impurities, wherein the binder phase contains iron aluminide containing FeA1 as a main component and alumina that is dispersed in the iron aluminide and has a particle size of 1 μm or less, the binder phase further contains at least one selected from the group consisting of boron, silicon, chromium, niobium and molybdenum, and the hard phase includes at least one selected from the group consisting of carbides, nitrides, carbonitrides, borides of Group 4 metals, Group 5 metals or Group 6 metals in the periodic table, and solid solutions thereof.

8. The hard sintered body according to claim 7, wherein a content of the alumina in the binder phase is from 24.2 to 50.0 mol %.

9. The hard sintered body according to claim 7, wherein a content of aluminum in iron aluminide in the binder phase is from 24.6 to 57.7 mol %.

10. A cutting or wear-resistant tool comprising the hard sintered body according to claim 7 as a raw material.

* * * * *